US008927061B2

(12) United States Patent
Hikasa et al.

(10) Patent No.: US 8,927,061 B2
(45) Date of Patent: Jan. 6, 2015

(54) METHOD OF HYDRAULIC TRANSFER AND HYDRAULIC TRANSFER BASE FILM

(75) Inventors: Shintaro Hikasa, Kurashiki (JP); Takanori Isozaki, Kurashiki (JP); Toru Sanefuji, Okayama (JP); Nobuo Tanaka, Osaka (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 0 days.

(21) Appl. No.: 13/296,840

(22) Filed: Nov. 15, 2011

(65) Prior Publication Data

US 2012/0055364 A1 Mar. 8, 2012

Related U.S. Application Data

(62) Division of application No. 10/576,722, filed as application No. PCT/JP2004/015582 on Oct. 21, 2004.

(30) Foreign Application Priority Data

Oct. 22, 2003 (JP) ..... 2003-362026
Oct. 27, 2003 (JP) ..... 2003-366453

(51) Int. Cl.
*B44C 1/175* (2006.01)

(52) U.S. Cl.
CPC ..... *B44C 1/1758* (2013.01)
USPC ..... 427/256; 427/149; 427/430.1

(58) Field of Classification Search
CPC ..... B44C 1/1758; B05D 1/20
USPC ..... 427/146, 149, 430.1, 256, 434.3; 156/230–241; 118/402
See application file for complete search history.

(56) References Cited

U.S. PATENT DOCUMENTS

| | | | | |
|---|---|---|---|---|
| 3,220,992 | A | 11/1965 | Smyser et al. | |
| 3,316,190 | A * | 4/1967 | Suzumura et al. | 524/48 |
| 4,231,829 | A * | 11/1980 | Marui et al. | 156/230 |
| 6,497,779 | B1 * | 12/2002 | Suzuki et al. | 156/230 |

FOREIGN PATENT DOCUMENTS

| | | |
|---|---|---|
| EP | 0 953 460 | 11/1999 |
| JP | 51-21914 | 2/1976 |
| JP | 54-33115 | 3/1979 |
| JP | 54-92406 | 7/1979 |
| JP | 54-150208 | 11/1979 |
| JP | 55-17550 | 2/1980 |
| JP | 58-191187 | 11/1983 |
| JP | 04-119850 | 4/1992 |
| JP | 04-308798 | 10/1992 |
| JP | 07-117328 | 5/1995 |
| JP | 2003-011590 | 1/2003 |
| JP | 2003-094895 | 4/2003 |

OTHER PUBLICATIONS

Supplementary European Search Report mailed Nov. 3, 2010, in EP 04792732, filed Oct. 21, 2004.

* cited by examiner

*Primary Examiner* — Alex A Rolland
(74) *Attorney, Agent, or Firm* — Oblon, Spivak, McClelland, Maier & Neustadt, L.L.P.

(57) ABSTRACT

In a method for hydraulic transfer printing, comprising floating a transfer sheet comprising a polyvinyl alcohol polymer film and a print layer formed thereon on a surface of an aqueous solution while directing the print layer upward, and then pressing an article against the surface of the aqueous solution to transfer the print layer to the article, wherein the surface tension of the aqueous solution is adjust to 45 mN/m or less and the extension ratio of the transfer sheet is adjusted to 1.30 or less during the transfer. This makes it possible to transfer a high-definition print pattern to the surface of an article having irregularities or a curved surface.

13 Claims, No Drawings

METHOD OF HYDRAULIC TRANSFER AND HYDRAULIC TRANSFER BASE FILM

CROSS REFERENCE TO RELATED APPLICATION

This application is a divisional application of U.S. application Ser. No. 10/576,722, filed on Apr. 21, 2006, which is a 371 of PCT/JP04/15582, filed on Oct. 21, 2004, and claims priority to the following applications: Japanese Patent Application No. 2003-362026, filed on Oct. 22, 2003, and Japanese Patent Application No. 2003-366453, filed on Oct. 27, 2003.

TECHNICAL FIELD

The present invention relates to a method for hydraulic transfer printing which uses a transfer sheet comprising a polyvinyl alcohol polymer film and a print layer formed thereon and applies print patterns onto a surface of an article having irregularities or a curved surface. The present invention relates also to hydraulic transfer printing base films which can be used suitably for such a method for hydraulic transfer printing.

BACKGROUND ART

As a method for applying print to the surface of a non-flat article, a method is generally adopted which includes floating, on the surface of water, a transfer sheet having a print layer with the printed surface facing up to fully swell the sheet and then pressing an article downwardly towards the inside of water to transfer the print layer to the surface of the article (see, for example, JP 51-21914 A and JP 54-33115 A). For such transfer sheets, usually, films prepared from water-soluble or water-swellable resin such as a polyvinyl alcohol polymer (henceforth, a polyvinyl alcohol polymer is also abbreviated to as "PVA" and a polyvinyl alcohol polymer film is also abbreviated as "PVA film") have been used as base films. A base film for use in this application is required to be superior in printability, to swell when being floated on the surface of water, and to have a property of clinging to an article (that is, clinginess). Hydraulic transfer printing base films which meet such requirements were proposed in the past (see, for example, JP 54-92406 A and JP 54-150208 A). However, PVA films have a property to swell and extend gradually when being floated on water. Therefore, when a print layer is formed on a base film formed of PVA and transfer printing is carried out therewith, the print layer extends together with the base film swollen on the surface of water and a print pattern transferred to an article may differ from the original print pattern formed on the base film and, in particular, the print pattern may extend to blur. Thus, usual PVA films have a problem that it is impossible to transfer a clear and high-definition print pattern.

Although printing plates have been made with patterns scaled down, it has not been possible, even in such cases, to fully suppress blur of print patterns caused by extension of a transfer sheet. In order to solve this problem, proposed is a method comprising floating a transfer sheet on the surface of water to swell the sheet until the extension stress disappears, then scaling the sheet down gradually in its transverse direction, and transferring the patterns to an object while maintaining the sheet at a prescribed width (JP 4-308798 A). In addition, as an attempt to improve a base film itself, a thin film for transfer printing having a thickness of from 10 to 50 μm and made of PVA and a specific natural gum-based mucilage, wherein a swelling extensibility is 1.35 or less, which is an area magnification after a lapse of a time three times as long as a swelling time (that is, a time needed, when a thin film is floated on the surface of water at 25° C., until wavy wrinkles disappear so that the surface of the film is smoothened) is proposed (JP 7-117328 A). However, in the method disclosed in JP 4-308798 A, wrinkles may be formed in a transfer sheet during the scale down of the sheet or a print pattern may deform without being scaled down uniformly. Therefore, it may be impossible to transfer a print pattern printed in a transfer sheet to an article precisely. In the case of the thin film for transfer printing disclosed in JP 7-117328 A, it may be impossible to form a high-definition print pattern on a thin film due to a reduced surface smoothness of the thin film, or when a film is floated on the surface of water, the film may be wrinkled due to the swelling property difference between the PVA and the natural gum-based mucilage. It, therefore, may be impossible to transfer print a high-definition print pattern. Moreover, it may be difficult to remove the natural gum-based mucilage during a step of washing the thin film after transfer and, therefore, it is not sufficient as a film with suppressed extensibility on the surface of water.

In addition, a method comprising applying an ink activating solvent after floating a transfer sheet on the surface of water is proposed (for example, JP 58-191187 A). According to this method, it is possible to control to some extent a spread of a print pattern caused by swelling of a transfer sheet. In this method, however, no considerations are given to control a time of floating a transfer sheet on the surface of water or a time passing after an ink activating solvent is applied until transferring it to an object. Therefore, the method cannot solve the problem in transferring a high-definition pattern.

Patent reference 1: JP 51-21914 A
Patent reference 2: JP 54-33115 A
Patent reference 3: JP 54-92406 A
Patent reference 4: JP 54-150208 A
Patent reference 5: JP 4-308798 A
Patent reference 6: JP 7-117328 A
Patent reference 7: JP 58-191187 A

DISCLOSURE OF THE INVENTION

Problem to be Solved by the Invention

The present invention was created for solving the above-mentioned problems. An object of the present invention is to provide a method for hydraulic transfer printing using a transfer sheet comprising a polyvinyl alcohol polymer film as a base film and a print layer formed thereon, by which process high-definition print patterns are transferred to the surface of an article having irregularities or a curved surface. Another object is to provide a hydraulic transfer printing base film which can be used suitably for such a method for hydraulic transfer printing.

Means for Solving the Problem

The above-mentioned problems are solved by providing a method for hydraulic transfer printing, comprising floating a transfer sheet comprising a polyvinyl alcohol polymer film and a print layer formed thereon on a surface of an aqueous solution while directing the print layer upward, and then pressing an article against the surface of the aqueous solution to transfer the print layer to the article, wherein the aqueous solution has a surface tension of 45 mN/m or less and the transfer sheet exhibits an extension ratio of 1.30 or less during the transfer. Reduction of the surface tension to a specific level or less makes it possible to inhibit the extension of a transfer sheet on the surface of an aqueous solution caused by swelling of the sheet. As a result, high-definition patterns can be printed clearly on the surface of a non-flat article with irregularities.

In this situation, it is desirable that the surface tension of the solution is 15 mN/m or more. It is also desirable that the extension ratio of the transfer sheet during the transfer is 1.20 or less. It is also desirable that the aqueous solution contain from 0.001 to 3% by weight of a surfactant. It is also desirable that the solid content of the aqueous solution is from 0.001 to 5% by weight. It is also desirable to apply an ink activating solvent to the transfer sheet before floating the transfer sheet on the surface of the aqueous solution. It is also desirable that a time taken from the floating of the transfer sheet on the surface of the aqueous solution to the pressing of the article against the surface of the aqueous solution is from 40 to 240 seconds.

Further, the above-mentioned problems can be solved also by providing a hydraulic transfer printing base film comprising 100 parts by weight of a polyvinyl alcohol polymer and from 0.05 to 5 parts by weight of a surfactant, wherein an aqueous solution at 20° C. containing 0.01% by weight of the surfactant has a surface tension of 40 mN/m or less and the base film exhibits an extension ratio of 1.6 or less when the base film is floated on an aqueous solution at 30° C. including 0.05% by weight of the base film dissolved therein. This makes it possible, when a transfer sheet is prepared by forming a print layer on a hydraulic transfer printing base film of the present invention and transfer printing is carried out by using the transfer sheet, to inhibit extension of the sheet when floating it on the surface of water to swell it. As a result, it will become possible to transfer high-definition print patterns to the surface of a non-flat article with irregularities.

In this situation, it is desirable that the base film includes a plasticizer in an amount of from 0.5 to 10 parts by weight based on 100 parts by weight of the polyvinyl alcohol polymer, that the base film includes starch in an amount of from 0.1 to 15 parts by weight based on 100 parts by weight of the polyvinyl alcohol polymer, and that the base film includes boric acid or a derivative thereof in an amount of from 0.1 to 5 parts by weight based on 100 parts by weight of the polyvinyl alcohol polymer.

It is desirable that the water content of the base film is from 1.5 to 4% by weight. It is also desirable that the retardation of the base film is 40 nm or less. It is also desirable that the thickness of the base film is from 20 to 50 μm. Further, it is also desirable that the transverse shrinkage of the base film is from 0.01 to 1.5% when a tension of 8.0 kg/m is applied in the longitudinal direction of the film at 50° C. for one minute.

It is desirable that the time (T1), needed from the time when the base film is floated on the surface of an aqueous solution at 30° C. including 0.05% by weight of the base film dissolved therein to the time when the film shrinks, is from 5 to 20 seconds. It is desirable that the time (T2), needed until the base film dissolves completely in water at 30° C., is from 15 to 40 seconds. It is desirable that the ratio (T1/T2) of the time (T1), needed from a time when the base film is floated on the surface of an aqueous solution at 30° C. including 0.05% by weight of the base film dissolved therein to a time when the film shrinks, to the time (T2), needed until the base film dissolves completely in water at 30° C., is from 0.3 to 0.8. A transfer sheet comprising the aforementioned hydraulic transfer printing base film and a print layer formed thereon is also a preferred embodiment of the present invention.

Effect of the Invention

By use of the method for hydraulic transfer printing of the present invention, it is possible to transfer high-definition print patterns to the surface of an article having irregularities or a curved surface by using a transfer sheet in which a print layer has been formed on a polyvinyl alcohol polymer film as a base film. Further, it is also possible to transfer high-definition print patterns to the surface of an article having irregularities or a curved surface by use of the hydraulic transfer printing base film of the present invention.

BEST MODE FOR CARRYING OUT THE INVENTION

In the method for hydraulic transfer printing of the present invention, a transfer sheet comprising a polyvinyl alcohol polymer film and a print layer formed thereon is floated on the surface of an aqueous solution while the print layer is directed upward. An article is then pressed against the surface of the aqueous solution. The print layer is thereby transferred to the article. In this situation, it is important that the surface tension of the aqueous solution is 45 mN/m or less and the extension ratio of the transfer sheet during the transfer is 1.30 or less.

The surface tension of the aqueous solution used in the method for hydraulic transfer printing of the present invention is 45 mN/m or less, desirably 40 mN/m or less, and more desirably 35 mN/m or less. By adjusting the surface tension of the aqueous solution to a specific value or lower, it is possible to inhibit the transfer sheet from extending due to its swelling on the surface of the aqueous solution. As a result, it becomes possible to print high-definition patterns to the surface of a non-flat article having irregularities. When the surface tension of an aqueous solution exceeds 45 mN/m, an effect of suppressing the extension of a transfer sheet on the surface of the aqueous solution is reduced, leading to occurrence of print pattern blur in a state where the print has been extended. Thus, it will become impossible to transfer a clear, high-definition pattern. On the other hand, when the surface tension of an aqueous solution is too small, bubbles formed during stirring of an aqueous solution become difficult to disappear. It, therefore, may be impossible to transfer a high-definition pattern to an article due to remaining of bubbles in a printed pattern. For such reasons, the surface tension of the aqueous solution is desirably 15 mN/m or more and more desirably 20 mN/m or more. Here, the surface tension of the aqueous solution is a value measured at a concentration and temperature of the aqueous solution to be used when transfer printing is conducted.

In the method for hydraulic transfer printing of the present invention, the extension ratio of the transfer sheet exhibited when the transfer sheet is floated on the surface of an aqueous solution and the transfer printing is conducted is 1.30 or less, desirably 1.20 or less, and more desirably 1.10 or less. In order to reproduce patterns of a printing plate faithfully, it is most desirable the transfer sheet exhibit no dimensional changed (that is, the extension ratio is 1.0). However, adjustment of the extension ratio to 1.30 or less also allows patterns to be transferred more precisely in comparison to the case where a transfer sheet is extended to an extension ratio of 1.5 or more like before. On the other hand, a case where the extension ratio is less than 1.0 is undesirable because a transfer sheet will come to have a width smaller than its original width, resulting in decrease in production efficiency. In addition, in the case of continuous transfer, problems with process passing ability may occur; for example, a transfer sheet may meander on the surface of water, leading to failure in achieving stable transfer printing. Therefore, the extension ratio is desirably 1.0 or more. The extension ratio of a transfer sheet indicates the degree of the spread of a print pattern at the time when a predetermined time has passed after the transfer sheet coated with an ink activating solvent was floated on the surface of an aqueous solution. It is measured by the method disclosed in the Examples provided later.

The method for adjusting the surface tension of an aqueous solution to 45 mN/m or less is not particularly restricted and may be a method in which the surface tension of an aqueous solution is adjusted by addition of a proper amount of commercially available nonionic or ionic surfactant or organic solvent such as hydrocarbon, ether and alcohol to water. In particular, adjustment by use of a surfactant is preferred. The surfactant may be added itself to an aqueous solution. It is also permissible, as described later, that a surfactant included in a base film is added as a result of its dissolution in an aqueous solution.

There is no particular limitation on the surfactant to be used if it is one which is water-soluble and which has a surface activating ability. Any of nonionic surfactants, anionic surfactants, cationic surfactants and amphoteric surfactants may be used. In particular, a nonionic surfactant, especially, polyoxyethylene alkyl ether represented by formula (1) is preferably employed because it gives good release ability to a base film when it is formed and it has a moderate surface activating ability and also because it is relatively inexpensive.

$$R—O(CH_2CH_2O)_nH \quad (1)$$

wherein R is a saturated or unsaturated chain hydrocarbon group having 6-20 carbon atoms and n is an integer of 2-20.

In the formula (1), the saturated or unsaturated chain hydrocarbon group having 6-20 carbon atoms may be an alkyl or alkenyl group having 6-20 carbon atoms, which may be linear or branched.

The content of the surfactant in the aforementioned aqueous solution is desirably from 0.001 to 3% by weight, more desirably from 0.003 to 1.5% by weight, and even more desirably from 0.005 to 1% by weight. When the content of the surfactant is less than 0.001% by weight, an effect of suppressing the extension of a transfer sheet on the surface of the aqueous solution is reduced, leading to occurrence of print pattern blur in a state where the print has been extended. Thus, it may become impossible to transfer a clear, high-definition pattern. On the other hand, when the content of the surfactant is more than 3% by weight, bubbles formed during stirring of the aqueous solution containing the surfactant are difficult to disappear and bubbles will remain in a print pattern. It, therefore, may be impossible to realize beautiful transfer to an article.

When the aqueous solution to be used for hydraulic transfer printing is used repeatedly, PVA, which is a raw material of a base film, dissolves, resulting in increase in solid concentration in the aqueous solution. Therefore, the time needed until a transfer sheet is swollen may change with time. This tendency is particularly prominent when hydraulic transfer printing is carried out continuously using a transfer sheet wound in roll. In some cases, it will become impossible to continue stable operation. For such reasons, it is desirable, in the method for hydraulic transfer printing of the present invention, to control the solid concentration of an aqueous solution by dissolving, in advance, a transfer sheet made from a polyvinyl alcohol polymer described later into the aqueous solution. The solid concentration of the aqueous solution is desirably from 0.001 to 5% by weight, more desirably from 0.05 to 4% by weight, and even more desirably from 0.1 to 3% by weight. When the solid concentration of an aqueous solution exceeds 5% by weight, the viscosity of the aqueous solution will increase and, therefore, it may become difficult to conduct transfer printing to an article or it may become impossible to transfer a high-definition print pattern to an article due to adhesion of a print pattern staying in the aqueous solution to the surface of a hydraulic transfer printing film during the transfer printing. On the other hand, when the solid concentration of an aqueous solution is less than 0.001% by weight, effects caused by control of the solid concentration of an aqueous solution may not be exhibited.

Here, the solid concentration (% by weight) of an aqueous solution is represented by $(V1/V2)\times100$, wherein the weight of the aqueous solution after its drying at 105° C. for 24 hours is expressed by V1 and the weight of the aqueous solution before its drying is expressed by V2.

In the present invention, the temperature of an aqueous solution used for hydraulic transfer printing is desirably from 10 to 40° C., more desirably from 20 to 36° C., and even more desirably from 25 to 33° C. When the temperature of an aqueous solution is lower than 10° C., a time needed until a transfer sheet comprising a polyvinyl alcohol polymer film and a print layer formed thereon is swollen may become long and transfer print may need much time, leading to decrease in production efficiency. On the other hand, in the case where it exceeds 40° C., a time needed after the swelling of a transfer sheet until the dissolution of the transfer sheet will be short. Therefore, when an article is pressed against a transfer sheet floated on the surface of water during transfer, the transfer sheet swollen may yield to the pressing force to tear and it may be impossible to transfer print a high-definition pattern.

In the present invention, the polyvinyl alcohol polymer used for a hydraulic transfer printing base film in the present invention may be either a non-modified PVA or a modified PVA in which one sort or more of monomer such as olefins, e.g., ethylene and propylene; acrylic acid and acrylates; methacrylic acid and methacrylates; acrylamide derivatives; methacrylamide derivatives; vinyl ethers; vinyl halides; allyl compounds; maleic acid and its salts or esters; and vinyl silyl compounds have been copolymerized within a range such that the effect of the present invention is not affected. In general, the amount of modification by such monomers is desirably 25 mol % or less, and more desirably 5 mol % or less.

The degree of polymerization of a polyvinyl alcohol polymer is desirably from 500 to 5000, more desirably from 700 to 4000, and even more desirably from 1000 to 3000. When the degree of polymerization of a polyvinyl alcohol polymer is less than 500, the mechanical strength as a base film may be insufficient and, in particular, a film may rupture in the course of, for example, continuous printing. On the other hand, when the degree of polymerization of a polyvinyl alcohol polymer exceeds 5000, the production efficiency of the polyvinyl alcohol polymer may fall or the water solubility of the polyvinyl alcohol polymer may fall and, therefore, it may become difficult to achieve a hydraulic transfer rate economical as a transfer sheet.

The degree of saponification of a polyvinyl alcohol polymer is desirably from 80 to 99.9 mol %, more desirably from 80 to 99 mol %, even more desirably from 82 to 95 mol %, particularly desirably from 85 to 93 mol %, and most desirably from 87 to 91 mol %. When the degree of saponification of a polyvinyl alcohol polymer is less than 80 mol %, the rate at which a PVA film is dissolved in water may decrease or a PVA film may become insoluble in water. Therefore, when it is fabricated into a transfer sheet, the passing ability at a transfer step is deteriorated or a print pattern may deform due to extension of the film during printing. In many cases, it is difficult to industrially produce a PVA having a too high degree of saponification.

As previously mentioned, reduction in surface tension of an aqueous solution makes it possible to inhibit a transfer sheet from extending caused by its swelling on the surface of the aqueous solution. As a result, it becomes possible to print a high-definition pattern on the surface of a non-flat article having irregularities. It is also possible to reduce the surface tension of an aqueous solution by use of a hydraulic transfer printing base film made of PVA containing a surfactant. In this case, when a transfer operation is repeated, the PVA and the surfactant dissolve into the aqueous solution. Therefore, it is also possible to adjust the value of the surface tension of the aqueous solution automatically through adjustment of the concentrations of the PVA and the surfactant dissolved into prescribed ranges.

That is, it is possible to attain the objects of the present invention by use of a hydraulic transfer printing base film comprising 100 parts by weight of a polyvinyl alcohol polymer and from 0.05 to 5 parts by weight of a surfactant, wherein an aqueous solution at 20° C. containing 0.01% by weight of said surfactant has a surface tension of 40 mN/m or less and the base film exhibits an extension ratio of 1.6 or less when the base film is floated on an aqueous solution at 30° C. including 0.05% by weight of the base film dissolved therein.

The surfactant which the hydraulic transfer printing base film of the present invention contains is a surfactant such that an aqueous solution at 20° C. containing 0.010 by weight of the surfactant has a surface tension of 40 mN/m or less. By use of the surfactant, when a transfer sheet is prepared by forming a print layer on a hydraulic transfer printing base film of the present invention and then transfer printing is carried out using the sheet, the extension of the transfer sheet when the sheet is floated and swollen on the surface of water can be suppressed. The surface tension is desirably 38 mN/m or less, and more desirably 36 mN/m or less. When the surface tension exceeds 40 mN/m, it is impossible to suppress the extension of a film on the surface of the water and it may be impossible to realize transfer of a high-definition print pattern to an article. On the other hand, the surface tension is desirably 15 mN/m or more. When the surface tension is less than 15 mN/m, bubbles may be generated in the aqueous solution and the process passing ability may be deteriorated.

As a surfactant, any surfactant conventionally used as a component to be added to base films may be used if the surface tension in an aqueous solution state satisfies the above-mentioned condition. Examples of the surfactant include nonionic or ionic surfactants. Examples of nonionic surfactants include polyoxyethylene alkyl ethers such as polyoxyethylene oleyl ether and polyoxyethylene lauryl ether; polyoxyethylene alkyl phenyl ethers such as polyoxyethylene octyl phenyl ether; polyoxyethylene alkyl esters such as polyoxyethylene laurate; polyoxyethylene alkylamines such as polyoxyethylene lauryl aminoether; polyoxyethylene alkyl amides such as polyoxyethylene lauric acid amide; alkanol amides such as oleic acid diethanol amide; and polyoxyalkylene allyl phenyl ethers such as polyoxyalkylene allyl phenyl ether. Examples of anionic surfactants include carboxylate such as potassium laurate; sulfates such as octyl sulfate; and sulfonates such as dodecylbenzene sulfonate. Examples of cationic surfactants include amines such as lauryl amine hydrochloride; and quaternary ammonium salts such as lauryltrimethylammonium chloride. The surfactants may be used solely or in combination of two or more sorts of them.

In the present invention, the surfactant is used in an amount of from 0.05 to 5 parts by weight, desirably from 0.07 to 4 parts by weight, and even more desirably from 0.1 to 3 parts by weight based on 100 parts by weight of the polyvinyl alcohol polymer. When the amount of the surfactant is less than 0.05 parts by weight, the extension of a hydraulic transfer printing base film is suppressed when the film is floated on the surface of water to be swollen and therefore it may become impossible to achieve transfer printing of a high-definition print pattern. When the amount of the surfactant exceeds 5 parts by weight, the surfactant may bleed to the surface of a film to cause blur of print or may cause soil of the film.

It is important that the extension ratio when the base film is floated on an aqueous solution at 30° C. including 0.05% by weight of the base film dissolved therein is 1.6 or less. In the case where the extension ratio of a base film exceeds 1.6, when a print layer is formed and transfer printed to an article, a print pattern transferred is extended in comparison to an original pattern to blurred or deformed. As a result, it may become impossible to achieve transfer printing of a high-definition print pattern. The extension ratio of a base film is desirably 1.4 or less. On the other hand, the extension ratio of a base film is desirably 0.9 or more. When the extension ratio of a base film is 0.9 or less, a transfer sheet comes to have a width smaller than its original width, resulting in decrease in production efficiency. In addition, in the case of continuous transfer, problems with process passing ability may occur; for example, a transfer sheet may meander on the surface of water, leading to failure in achieving stable transfer printing. The extension ratio of a base film is more desirably 0.95 or more. The extension ratio of a base film indicates a degree of extension of a print pattern determined when a predetermined time has been passed from a time when the hydraulic transfer printing base film was floated on the surface of an aqueous solution. A detailed method for its measurement will be described in Examples.

For the purpose of imparting flexibility or improving water solubility, a plasticizer is desirably contained in a hydraulic transfer printing base film of the present invention. There are no particular limitations with respect to the type of the plasticizer to be used, but polyhydric alcohol plasticizers such as glycerin, diglycerin, trimethylene glycol, propylene glycol and diethylene glycol are desirable. In particular, use of glycerin is preferred. The amount of a plasticizer added is desirably from 0.5 to 10 parts by weight, and more desirably from 1 to 10 parts by weight, based on 100 parts by weight of a polyvinyl alcohol polymer. When the amount of a plasticizer added is less than 0.5 parts by weight, a film may rupture during printing due to reduction in impact resistance of the film. When it exceeds 10 parts by weight, a film may extend during printing or the film may suffer from blocking due to moisture absorption by the film.

For the purpose of adjusting, for example, mechanical strength necessary when a print layer is formed on a base film, moisture resistance during handling of a transfer sheet in which a print layer has been formed, flexibility of a transfer sheet due to its water absorption when the sheet is floated on the surface of water, and extendability and diffusibility on the surface of water, starch and water soluble macromolecules other than the aforementioned polyvinyl alcohol polymer may be contained in a hydraulic transfer printing base film of the present invention.

Examples of starch used for this purpose include natural starches such as cornstarch, potato starch, sweet potato starch, wheat starch, rice starch, tapioca starch and sago starch; and processed starches resulting from etherification process, esterification process, oxidization process, etc. Among them, processed starches are preferably used. Addition of starch will produce an effect of suppressing adhesion of a film itself or adhesion of a film with a metal roll in addition to the effect previously mentioned. Occurrence of adhesion of a film itself is undesirable because it will cause extension of a film, for example, in the course of continuous printing to a base film. The amount of starch added is desirably from 0.1 to 15 parts by weight, more desirably from 0.3 to 10 parts by weight, and even more desirably from 0.5 to 5 parts by weight, based on 100 parts by weight of a polyvinyl alcohol polymer.

Examples of the water soluble macromolecules include dextrin, gelatin, glue, casein, shellac, gum arabic, polyacrylic acid amide, poly(sodium acrylate), polyvinyl methyl ether, copolymers of vinyl methyl ether and maleic anhydride, copolymers of vinyl acetate and itaconic acid, polyvinyl pyrrolidone, cellulose, acetyl cellulose, acetyl butyl cellulose, carboxymethyl cellulose, methyl cellulose, ethyl cellulose, hydroxyethyl cellulose and sodium alginate. The amount of a water-soluble macromolecule added is desirably 15 parts by weight or less, and more desirably 10 parts by weight or less, based on 100 parts by weight of a polyvinyl alcohol polymer. When the amount of a water-soluble macromolecule exceeds 15 parts by weight, the solubility or dispersibility of a transfer sheet at the time of hydraulic transfer printing may be deteriorated.

Unless the effects of the present invention are affected, additives such as inorganic salts may be added to a hydraulic transfer printing base film of the present invention in order to adjust the rate of flexibilization of the film due to its water absorption after being floated on the surface of water, extendability of the film on the surface of water, and the time needed until the film is diffuse in water.

The inorganic salts are not particularly restricted and examples thereof include boric acid or its derivative, e.g., boric acid and borax. The amount of an inorganic salt added is desirably 5 parts by weight or less, and more desirably 1 part by weight or less, based on 100 parts by weight of a polyvinyl alcohol polymer. An amount over 5 parts by weight is undesirable because it will result in great reduction in water solubility of a base film. The amount of an inorganic salt added is desirably 0.1 parts by weight or more based on 100 parts by weight of a polyvinyl alcohol polymer.

It is also permissible to add heat stabilizers, UV absorbers, antioxidants, colorants, filler, etc. to a hydraulic transfer printing base film of the present invention unless the objects of the present invention are affected. Normally, the amount of such additives added is desirably 10 parts by weight or less, and more desirably 5 parts by weight or less, based on 100 parts by weight of a PVA. When the amount of an additive added exceeds 10 parts by weight, the impact resistance of a PVA film may be deteriorated.

A hydraulic transfer printing base film of the present invention can be produced by a conventionally known method, such as a method including casting of an aqueous solution containing a polyvinyl alcohol polymer and an aforesaid surfactant.

The water content of a hydraulic transfer printing base film of the present invention is desirably from 1.5 to 4% by weight, more desirably from 1.8 to 3.5% by weight, and even more desirably from 2 to 3% by weight. When the water content of a base film exceeds 4% by weight, a print pattern may blur when a print layer is formed or the film may extend in its longitudinal direction during printing. When the water content of a base film is less than 1.5% by weight, not only the film tends to rupture due to reduction in it impact resistance, but also the film tends to have static electricity and therefore it may become impossible to be applied with high-definition printing due to sticking of dust or dirt. The water content can be achieved by, for example, adjusting drying conditions in the course of film production.

The retardation of a hydraulic transfer printing base film of the present invention is desirably 40 nm or less, and more desirably 34 nm or less. Here, the retardation is expressed by a product of the birefringence and thickness of a base film (birefringence×thickness). The birefringence is determined depending on the degree of molecular orientation of a film imparted during a film forming process or the like. A case where the retardation exceeds 40 nm is undesirable because wrinkles are formed in the surface of a base film, possibly due to difference in stress between the longitudinal direction and the transverse direction of the film, particularly when the film has absorbed moisture, and as a result, the formation of a print layer having a high-definition print pattern may be inhibited or a print pattern may deform due to extension of a transfer sheet in an uneven state when the sheet is floated on the surface of water. In order to make the retardation be 40 nm or less, it is important to fully dry a film on a drum or belt during the production of the film, followed by winding it while keeping it free of tension in the following steps.

The thickness of a hydraulic transfer printing base film of the present invention is desirably from 20 to 50 μm, and more desirably from 25 to 45 μm. When the thickness exceeds 50 μm, the production efficiency may be reduced because much time is needed to swell the base film floated on the surface of water or much time is needed to remove the base film (film stripping) after transfer. When the thickness is less than 20 μm, reduction in film strength may cause rupture of the film when printing is carried out or when an article is pressed against the film downwardly during hydraulic transfer printing and, as a result, it may be impossible to conduct transfer printing.

It is also desirable for a hydraulic transfer printing base film of the present invention that its transverse shrinkage is from 0.01 to 1.5% when a tension of 8.0 kg/m is applied in the longitudinal direction of the film at 50° C. for one minute. Cases where the transverse shrinkage of a base film under the aforesaid conditions exceeds 1.5% are undesirable because a print pattern of a print layer may deform during printing or misalignment of the print patterns may occur during multicolor printing. In the case where the transverse shrinkage is less than 0.01%, when a base film is applied to continuous printing, the film may rupture, for example, at change in tension. Moreover, such a case is undesirable from the viewpoint of passing ability in the step of printing of a base film. The transverse shrinkage is more desirably from 0.05 to 1.0%.

A hydraulic transfer printing base film of the present invention desirably has been matted on its surface for the purpose of improving the slip property of the surface of the film or improving the appearance of a transfer sheet in which a print layer has been formed. Examples of a method of matting include an on-line matting method in which a matte surface on a roll or belt is transferred to a film during the production of the film and a method in which a film is once wound around a roll and then the film is subjected to embossing. The surface roughness of a film matted, Ra, is desirably 0.5 μm or more, and more desirably 1 μm or more.

There are no particular limitations on the length and width of a PVA film to be used in the present invention, but, from the viewpoint of production efficiency at the time of printing of a PVA film, the lower limit of the length is desirably 1 m or more, more desirably 100 m or more, and even more desirably 1000 m or more. The upper limit of the length of a PVA film is desirably 5000 m or less, and more desirably 3000 m or less. The lower limit of the width of a PVA film is desirably 50 cm or more, more desirably 80 cm or more, and even more desirably 100 cm or more. When the width of a PVA film is less than 50 cm, the production efficiency at the time of printing may decrease. The upper limit of the width of a PVA film is desirably 4 m or less, and more desirably 3 m or less. When the width exceeds 4 m, the production of a PVA film uniform in thickness may become difficult.

It is desirable that the time (T1), needed from a time when the base film is floated on the surface of an aqueous solution at 30° C. including 0.05 by weight of the base film dissolved therein to a time when the film shrinks, is from 5 to 20 seconds. When the time (T1) is long, a film will swell insufficiently and wrinkles are formed in print pattern when transfer printing is carried out. In contrast, when it is short, the extendability of a film can not be controlled sufficiently due to a great dimensional change of the film on the surface of water. In both cases, it may be impossible to transfer print a high-definition print pattern. The time (T1) is more desirably from 8 to 17 seconds. Here, the time (T1) indicates a time after a film is floated on the surface of water until wrinkles are formed throughout the surface of the film. The time (T1) can be controlled by the thickness of a film, etc.

It is desirable that the time (T2), needed until the base film dissolves completely in water at 30° C., is from 15 to 40 seconds. When the time (T2) is long, the release ability of a film after transfer may decrease, whereas when the time is short, it may be impossible to apply transfer printing to a portion of great depth in a case where transfer printing is applied to a three-dimensional object. The time (T2) is more desirably from 18 to 37 seconds. The time (T2) can be controlled by the degree of saponification of a polyvinyl alcohol polymer, the amount of a plasticizer, etc.

It is desirable that the ratio (T1/T2) of the time (T1), needed from a time when the base film is floated on the surface of an aqueous solution at 30° C. including 0.05% by weight of the base film dissolved therein to a time when the film shrinks, to the time (T2), needed until the base film dissolves completely in water at 30° C., is from 0.3 to 0.8. It was found that by letting the ratio (T1/T2) be within a specific range, it is possible to transfer print a high-definition print pattern without causing the above mentioned problems. The ratio (T1/T2) is more desirably 0.34 or more. The ratio (T1/T2) is more desirably 0.7 or less, and even more desirably 0.5 or less.

It is desirable that the surface tension of an aqueous solution at 30° C. dissolving 0.5% by weight of the transfer sheet comprising a base film and a print layer formed thereon be 45 mN/m or less. This surface tension is one determined by assuming the surface tension of an aqueous solution containing a proper amount of the base film of the present invention dissolved therein when an actual transfer operation is carried out. When the surface tension of an aqueous solution exceeds 45 mN/m, the effect that extension of a transfer sheet is controlled on the surface of the aqueous solution is reduced. The surface tension of an aqueous solution is desirably 40 mN/m or less, and more desirably 35 mN/m or less. On the other hand, when the surface tension of an aqueous solution is too small, a transfer solution including the base film dissolved therein will heavily foam, which may cause problems such as occurrence of a defect in a print pattern caused by entering of foams between an article and a transfer printing sheet during transfer printing. For such reasons, the surface tension of the aqueous solution is desirably 15 mN/m or more and more desirably 20 mN/m or more. The adjustment of the surface tension of an aqueous solution to the aforementioned range can be achieved through adjustment of degree of saponification or degree of polymerization of the polyvinyl alcohol polymer or the kinds or amounts of additives such as a surfactant.

For application of print to a base film, conventional printing systems such as gravure printing, screen printing, offset printing and roll coating may be employed. Conventional types of ink may be used as printing ink. As a printing ink for use in that operation, a printing ink comprising a binder made of water-insoluble resin, a colorant such as dye and pigment, and a solvent is suitably used. Examples of the water-insoluble resin include cellulose nitrate, alkyd resin, amino resin, acrylic resin, vinyl resin, rosin ester and maleic acid-modified rosin ester, which may be used as a mixture. Examples of the solvent include toluene, ethyl acetate, methyl ethyl ketone, methyl isobutyl ketone, glycol ether, ethyl alcohol, isopropyl alcohol, butyl alcohol, butyl phthalate and octyl phthalate, which may be used as a mixture.

For the purpose of flexibilizing the print layer on the transfer sheet before floating the transfer sheet on the surface of the solution and thereby causing the print layer to exhibit clinginess to an article, an ink activating solvent is usually applied. This operation is recommended also in the present invention. In this case, although the clinginess is improved by flexibilizing the print layer in advance, the transfer sheet becomes prone to extend through its swelling. Therefore, it becomes particularly important to inhibit extension of the transfer sheet through control of a surface tension as in the present invention. Examples of the ink activating solvent include butyl cellosolve acetate, butyl carbitol acetate, butyl methacrylate, dibutyl phthalate and barium sulfate.

The transfer of the print layer to an article using a transfer sheet is carried out by floating the transfer sheet on the surface of an aqueous solution while directing the print layer upward, and then pressing an article against the surface of the aqueous solution.

It is desirable that a time taken from the floating of the transfer sheet on the surface of the aqueous solution to the pressing of the article against the surface of the aqueous solution is from 40 to 240 second, and more desirably from 60 to 180 seconds. When the time before starting the transfer to an article is less than 40 seconds, the transfer sheet has been swollen insufficiently and, therefore, the extension force of the transfer sheet has not reached a fixed level and the relationship between extension force and suppression force has not attained equilibrium. It, therefore, may still be in progress of expansion of the print pattern. When the time before starting the transfer to an article exceeds 240 seconds, swelling of a transfer sheet will progress too much and the sheet will partly dissolve and will start to diffuse. This may cause uneven extension of a print pattern transferred to an article or, in extreme cases, may cause rupture.

During the production of products of the same lot, it is desirable to adjust the surface tension of the aqueous solution so that its change is minimized. Doing so will make it possible to continuously form a print pattern with a satisfactory reproducibility of dimensional accuracy. Since PVA dissolves in an aqueous solution through repetition of transfer operation, it is desirable to adjust the PVA concentration so as to be constant while adding water continuously. In order to also keep the surfactant concentration constant, use of a PVA film containing a surfactant as mentioned below is desirable because the operation is easy.

In the present invention, the extension ratio of a print pattern transferred on an article is desirably 1.35 or less, and more desirably 1.25 or less. For reproducing a pattern of a printing plate faithfully, it is desirable that the extension ratio of a transfer sheet is near 1.0. When, however, the extension ratio is less than 1.0, problems may arise in productivity or process passing ability. Therefore, the extension ratio of a print pattern is desirably 1.0 or more.

A transfer sheet comprising the hydraulic transfer printing base film of the present invention and a print layer formed thereon is used for applying print on an article such as wooden substrates such as wooden board, plywood and particle board; plastic articles; fiber cement products such as pulp cement board, slate board, asbestos cement board, GRC (glass fiber reinforced cement) article and concrete board; mineral boards such as plaster board, calcium silicate board and magnesium silicate board; boards made of metal such as iron, copper and aluminum, or their alloy boards; and composites thereof. Although the configuration of the surface of an article to which print is to be applied may be smooth, rough or having irregularities, the transfer sheet can be suitably used for printing to articles with irregularities and the like.

EXAMPLES

The present invention is described below in more detail, but the scope of the invention is not limited by them.

In the following Examples 1, 2 and Comparative Examples 1-4, the surface tension of an aqueous solution, the extension ratio of a transfer sheet and the extension ratio of a print pattern transferred to an article were measured as described below.

(Surface Tension of Aqueous Solution)

The measurement was carried out according to the Willhelmy plate method by use of a surface tension meter CBVP-A3 manufactured by Kyowa Interface Science Co., Ltd.

(Extension Ratio of Transfer Sheet)

Using a 20 cm×20 cm square transfer sheet, a circle with a diameter of 4 cm was drawn in the central portion thereof with a pen with water-based ink. Following application of an ink activating solvent to the transfer sheet by spraying, the transfer sheet was floated on the surface of an aqueous solution held at 30° C. When about 10 seconds passed, wrinkles appeared in the surface of the sheet. The wrinkles in the surface of the sheet disappeared gradually with time and, eventually, the surface of the sheet became completely smooth. When a period of time, four times that needed from the time when the transfer sheet was floated on the surface of the aqueous solution to the time when the surface of the sheet became smooth, had lapsed, the diameter of a portion of the circle drawn on the transfer sheet where the largest dimensional change was shown was measured. An "extension ratio of the transfer sheet" was calculated by dividing the measured diameter by the original diameter (4 cm).

(Extension Ratio of Print Pattern Transferred to Article)

In the same manner as that in the measurement of the extension ratio of a transfer sheet, when a period of time, four times that needed from the time when the transfer sheet was floated on the surface of the aqueous solution to the time when the surface of the sheet became smooth, had lapsed, an ABS resin plate with thickness of 4 mm and dimensions of 20 cm×20 cm was pressed against and in parallel with the surface of water. A print pattern was thereby transferred to the ABS resin plate. The diameter of a portion of the circle transferred to the ABS resin plate together with the print pattern, where the largest dimensional change was shown, was measured. An "extension ratio of the print pattern transferred to the article" was calculated by dividing the measured diameter by the original diameter (4 cm).

Example 1

A 15 wt % aqueous solution of a composition composed of 100 parts by weight of polyvinyl alcohol having a degree of polymerization of 1780 and a degree of saponification of 88 mol %, 5 parts by weight of glycerin and 5 parts by weight of etherificated starch was subjected to cast film production through its extrusion onto a drum surface with a matted surface at a surface temperature of 90° C. Thus, a matted base film of 30 μm in thickness was produced. To a flat surface (a non-matted surface) of the base film, a wood grain pattern was printed using a gravure ink composed of pigment (brown)/alkyd resin/toluene/ethyl acetate/isopropyl alcohol=10/20/20/30/20 (weight ratio), yielding a transfer sheet.

A part of the transfer sheet obtained and polyoxyethylene lauryl ether (surface tension measured at 20° C. using a 0.01 wt % aqueous solution=27.8 mN/m; molar number (n) of oxyethylene added=5; hydrophile-lipophile balance HLB=10.8) were dissolved in water and the temperature of the water was held at 30° C. in a bath. The resulting aqueous solution had a surface tension of 30.2 mN/m, a polyoxyethylene lauryl ether content of 0.01% by weight, and a solid content of 0.10% by weight. The aforesaid transfer sheet was cut into a 20 cm×20 cm square and an ink activating solvent (a mixture of 26 parts by weight of butyl cellosolve acetate, 26 parts by weight of butyl carbitol acetate, 8 parts by weight of butyl methacrylate, 20 parts by weight of dibutyl phthalate and 20 parts by weight of barium sulfate) was applied to the transfer sheet by spraying. Then, the transfer sheet was floated on the surface of the aqueous solution with the printed surface facing up and the extension ratio of the transfer sheet was measured. Concerning the transfer sheet, wrinkles appeared in the sheet surface in 13 seconds after the sheet came into contact with the water surface, then the wrinkles disappeared and the sheet surface became smooth in the following 7 seconds (namely, 20 seconds after the sheet came into contact with the water surface). The extension ratio at a time 80 seconds after the transfer sheet came into contact with the water surface was 1.10. Separately, the aforesaid transfer sheet was cut into a 20 cm×20 cm square and an ink activating solvent was applied by spraying. The transfer sheet was then floated on the surface of the aqueous solution with the printed surface facing up. Subsequently, the print pattern was transferred to an ABS resin plate. The extension ratio of the print pattern transferred to the article was measured to be 1.12. It was found that a high-definition print pattern was transferred to the ABS resin plate clearly without any print omission or stain. The evaluation results are shown collectively in Table 1.

Example 2

Hydraulic transfer printing to an ABS resin plate was carried out in the same manner as Example 1 except using, in place of the polyoxyethylene lauryl ether (HLB=10.8), the same weight of polyoxyethylene oleyl ether (HLB=11.3) and adjusting the surface tension of an aqueous solution to 38.2 mN/m. The extension ratio of the transfer film was 1.26. The extension ratio of the print pattern transferred to an article 72 seconds after the transfer sheet came into contact with the water surface was 1.27. It was found that a high-definition print pattern was transferred to the ABS resin plate clearly without any print omission or stain. The evaluation results are shown collectively in Table 1.

Comparative Example 1

Hydraulic transfer printing to an ABS resin plate was carried out in the same manner as Example 1 except reducing the content of polyoxyethylene lauryl ether in an aqueous solution to adjust the surface tension of the aqueous solution to 50.3 mN/m. The extension ratio of the transfer film was 1.39. The extension ratio of the print pattern transferred to an article 72 seconds after the transfer sheet came into contact with the water surface was 1.42. There was no print omission or stain in the print pattern transferred to the ABS resin plate. However, no high-definition print pattern was formed due to the occurrence of pattern blur caused by swelling of the print pattern. The evaluation results are shown collectively in Table 1.

Comparative Example 2

Hydraulic transfer printing to an ABS resin plate was carried out in the same manner as Example 1 except using an aqueous solution whose surface tension was adjusted to 60.8 mN/m by dissolving only the transfer sheet. The extension ratio of the transfer film was 1.54. The extension ratio of the print pattern transferred to an article 68 seconds after the transfer sheet came into contact with the water surface was 1.57. There was no print omission or stain in the print pattern transferred to the ABS resin plate. However, no high-definition print pattern was formed due to the occurrence of pattern blur. The evaluation results are shown collectively in Table 1.

Comparative Example 3

Hydraulic transfer printing to an ABS resin plate was carried out in the same manner as Example 1 except using polyoxyethylene oleyl ether (HLB=15.0) in place of the polyoxyethylene lauryl ether (HLB=10.8) and adjusting the surface tension of an aqueous solution to 62.5 mN/m by further adding isopropanol. The solid content in the aqueous solution was 0.10% by weight. The extension ratio of the transfer film was 1.61. The extension ratio of the print pattern transferred to an article 72 seconds after the transfer sheet came into contact with the water surface was 1.64. There was no print omission or stain in the print pattern transferred to the ABS resin plate. However, no high-definition print pattern was formed due to the occurrence of pattern blur. The evaluation results are shown collectively in Table 1.

Comparative Example 4

Hydraulic transfer printing to an ABS resin plate was carried out in the same manner as Example 1 except that only water was filled in the bath and the temperature was adjusted to 20° C. (surface tension measured at 20° C.=72.8 mN/m). The extension ratio of the transfer film was 1.8. The extension ratio of the print pattern transferred to an article 68 seconds after the transfer sheet came into contact with the water surface was 1.85. There was no print omission or stain in the print pattern transferred to the ABS resin plate. However, no high-definition print pattern was formed due to the occurrence of pattern blur. The evaluation results are shown collectively in Table 1.

TABLE 1

| | Dissolved material in aqueous solution | Surface tension of aqueous solution (mN/m) | Extension ratio of transfer sheet (times) | Extension ratio of print pattern (times) |
|---|---|---|---|---|
| Example 1 | Transfer sheet Polyoxyethylene lauryl ether | 30.2 | 1.10 | 1.12 |
| Example 2 | Transfer sheet Polyoxyethylene oleyl ether | 38.2 | 1.26 | 1.27 |

TABLE 1-continued

| | Dissolved material in aqueous solution | Surface tension of aqueous solution (mN/m) | Extension ratio of transfer sheet (times) | Extension ratio of print pattern (times) |
|---|---|---|---|---|
| Comparative Example 1 | Transfer sheet Polyoxyethylene lauryl ether | 50.3 | 1.39 | 1.42 |
| Comparative Example 2 | Transfer sheet | 60.8 | 1.54 | 1.57 |
| Comparative Example 3 | Transfer sheet Polyoxyethylene oleyl ether Isopropanol | 62.5 | 1.61 | 1.64 |
| Comparative Example 4 | None | 72.8 | 1.80 | 1.85 |

Table 1 clearly shows that the extension ratio of a transfer sheet floated on the surface of an aqueous solution increases as the surface tension of the aqueous solution at the time of transfer rises. It, therefore, is shown that it is possible to transfer a print pattern to an article in a desired extension ratio by adjusting the surface tension of an aqueous solution to an appropriate value.

In the following Examples 3-6 and Comparative Examples 5-7, the surface tension of an aqueous solution, the water content of a base film, the retardation of a base film, the transverse shrinkage of a base film, the time (T1), the time (T2), the extension ratio of a base film and the extension ratio of a print pattern transferred to an article were determined by the following methods.

(Surface Tension of Aqueous Solution)

The measurement was carried out according to the Willhelmy plate method by use of a surface tension meter CBVP-A3 manufactured by Kyowa Interface Science Co., Ltd.

(Water Content)

The water content (%) of a base film was determined from the rate of change in weight as the base film was dried under a reduced pressure condition of 1 Pa or less, at 50° C. for 2 hours by use of a vacuum dryer (DP33 manufactured by Yamato Scientific Co., Ltd.) and a vacuum pump (VR16LP manufactured by Hitachi Koki Co., Ltd.).

$$\text{Water content (\%)}=[(\text{weight of film before drying}-\text{weight of film after drying})/\text{weight of film before drying}]\times 100$$

(Retardation)

The retardation of an arbitrary point of a base film was measured by use of an automatic birefringence analyzer (KOBRA 21SDH, manufactured by Oji Scientific Instruments).

(Transverse Shrinkage of Film)

The transverse shrinkage was determined from the following formula where the width of the sample film was represented by L1 and the width of the film after application of a tension of 8.0 kg/m in the longitudinal direction of the film at 50° C. for one minute was represented by L2:

$$\text{Transverse shrinkage (\%)}=[(L1-L2)/L1]\times 100$$

(Time (T1))

A hydraulic transfer printing base film was dissolved in water so that the concentration thereof became 0.05% by weight and the solution was placed in a bath to hold the temperature of water at 30° C. A hydraulic transfer printing base film which had been cut in a 20 cm×20 cm square was floated on the surface of the aqueous solution and then a time needed until the film swollen and wrinkles appeared in the whole surface of the film was measured, which was defined as time (T1).

(Time (T2))

A magnetic stirrer was installed in a thermostatic bath at 30° C. A 1-liter glass beaker containing 1 liter of distilled water was put into the thermostatic bath and stirring was conducted at 250 rpm using a 5-cm stirring bar. After the arrival of the distilled water in the beaker at 30° C., the measurement of water solubility was started. A film was cut into a 40×40 mm square piece, which was then inserted into a slide mount and was immersed in water at 30° C. under stirring. The dissolution state of the film was observed and a time (seconds) needed until the film to dissolve completely was measured, which was defined as time (T2).

(Extension Ratio of Film)

A hydraulic transfer printing base film was dissolved in water so that the concentration thereof became 0.05% by weight and the solution was placed in a bath to hold the temperature of water at 30° C. Separately, a hydraulic transfer printing base film was cut into a 20 cm×20 cm square and, in a central portion thereof, a circle with a diameter of 4 cm was drawn with a pen with water-based ink. The film was floated on the surface of the aforesaid aqueous solution. When about 10 seconds passed, wrinkles appeared in the surface of the film. The wrinkles in the surface of the film disappeared gradually with time and, eventually, the surface of the film became completely smooth. When a period of time, five times that needed from the time when the hydraulic transfer printing base film was floated on the surface of the aqueous solution to the time when the surface of the film became smooth, had lapsed, the diameter of a portion of the circle drawn on the base film where the largest diameter had been shown was measured. An "extension ratio of the base film" was calculated by dividing the largest diameter by the original diameter (4 cm).

(Extension Ratio of Print Pattern)

A transfer sheet was prepared by printing on a hydraulic transfer printing base film by means of a printer. An aqueous solution was prepared by dissolving the resulting transfer sheet in water so that the solid content became 0.5% by weight. The solution was placed in a bath and the water temperature was held at 30° C. Separately, the transfer sheet was cut into a 20 cm×20 cm square piece and, in a central portion thereof, a circle with a diameter of 4 cm was drawn with a pen with water-based ink. To this transfer sheet, an ink activating solvent (a mixture of 26 parts by weight of butyl cellosolve acetate, 26 parts by weight of butyl carbitol acetate, 8 parts by weight of butyl methacrylate, 20 parts by weight of dibutyl phthalate and 20 parts by weight of barium sulfate) was applied by spraying. Then, the transfer sheet was floated on the surface of the aqueous solution held at 30° C. When about 10 seconds passed, wrinkles appeared in the surface of the sheet. The wrinkles in the surface of the sheet disappeared gradually with time and, eventually, the surface of the sheet became completely smooth. When a period of time, four times that needed from the time when the transfer sheet was floated on the surface of the aqueous solution to the time when the surface of the sheet became smooth, had lapsed, a 4-mm thick ABS resin plate with dimensions of 20 cm×20 cm was pressed against and in parallel with the transfer sheet floating on the surface of the water. A print pattern was thereby transferred to the ABS resin plate. The diameter of a portion of the circle with a print pattern transferred thereon where the largest diameter had been shown was measured. An "extension ratio of the print pattern transferred to an article" was calculated by dividing the largest diameter by the original diameter (4 cm).

Example 3

Using a drum-type film producer, a 30 wt % aqueous solution of a composition composed of 100 parts by weight of polyvinyl alcohol having a degree of polymerization of 1750 and a degree of saponification of 88 mol %, 4 parts by weight of glycerin and 1.2 parts by weight of polyoxyethylene lauryl ether (surface tension measured at 20° C. using a 0.01 wt % aqueous solution=27.8 mN/m; molar number (n) of oxyethylene added=5; hydrophile-lipophile balance HLB=10.8) was discharged through a T-die onto a rotating drum having a surface temperature of 90° C. and followed by drying. Thus, a hydraulic transfer printing base film having a thickness of 30 μm was produced. The resulting base film had a water content of 3.6% by weight and a retardation of 30 nm. Further, the base film exhibited a transverse shrinkage of 1.1% when a tension of 8.0 kg/m was applied at 50° C. in the longitudinal direction of the film for one minute. The time (T2), needed until the base film dissolved completely in water at 30° C., was 26 seconds.

An aqueous solution was prepared by dissolving the resulting hydraulic transfer printing base film in water so that the content thereof became 0.05% by weight. The solution was placed in a bath and the water temperature was held at 30° C. A base film was cut into a 20 cm×20 cm square and, in a central portion thereof, a circle with a diameter of 4 cm was drawn with a pen with water-based ink. The film was floated on the surface of the aforesaid aqueous solution and the extension ratio of the base film was measured. In the base film, wrinkles appeared in the film surface in 9 seconds (T1) after the film came into contact with the water surface, then the wrinkles disappeared and the film surface became smooth in the following 5 seconds (namely, 14 seconds after the film came into contact with the water surface). The ratio (T1/T2) was 0.35. The extension ratio at a time 70 seconds after the base film came into contact with the water surface was 1.47.

The aforesaid hydraulic transfer printing base film was caused to pass through a preheater at 50° C. and then was subjected to three-color printing by a gravure printing system using a gravure ink composed of pigment, alkyd resin and solvent. Thus, a transfer sheet was produced. An aqueous solution was prepared by dissolving the resulting transfer sheet in water so that the solid content became 0.5% by weight. The solution was placed in a bath and the water temperature was held at 30° C. The surface tension of this aqueous solution was 39 mN/m.

Following application of an ink activating solvent to the printed surface of the transfer sheet by spraying, the transfer sheet was floated on the surface of an aqueous solution held at 30° C. with the printed surface facing up. In the transfer sheet, wrinkles appeared in the sheet surface in 12 seconds after the sheet came into contact with the water surface, then the wrinkles disappeared and the sheet surface became smooth in the following 7 seconds (namely, 19 seconds after the sheet came into contact with the water surface). 76 seconds later, a flat plate made of an ABS resin was forced in downwardly and thereby a print pattern was transferred to the ABS resin plate. The extension ratio of the print pattern transferred to the article was measured to be 1.32. It was found that a high-definition print pattern was transferred to the ABS resin plate clearly without any print omission or stain. The evaluation results are shown collectively in Table 2.

Example 4

Using a drum-type film producer, a 30 wt % aqueous solution of a composition composed of 100 parts by weight of polyvinyl alcohol having a degree of polymerization of 2050 and a degree of saponification of 89 mol %, 1.0 part by weight of polyoxyethylene oleyl ether (surface tension measured at 20° C. using a 0.01 wt % aqueous solution=31.1 mN/m; molar number (n) of oxyethylene added=8; hydrophile-lipophile balance HLB=11.3), 5 parts by weight of glycerin, 3 parts by weight of oxidized starch and 0.3 part by weight of boric acid was discharged through a T-die onto a rotating drum having a surface temperature of 90° C. and followed by drying. Thus, a hydraulic transfer printing base sheet having a thickness of 37 μm was produced. The resulting base film had a water content of 2.8% by weight and a retardation of 26 nm. Further, the base film exhibited a transverse shrinkage of 0.2% when a tension of 8.0 kg/m was applied at 50° C. in the longitudinal direction of the film for one minute. The time (T2), needed until the base film dissolved completely in water at 30° C., was 34 seconds.

When the base film was floated on the surface of an aqueous solution in a similar manner as Example 3, wrinkles appeared in the film surface in 12 seconds (T1) after the film came into contact with the surface of the solution, then the wrinkles disappeared and the film surface became smooth in the following 10 seconds (namely, 22 seconds after the film came into contact with the surface of the solution). The ratio (T1/T2) was 0.35. The extension ratio at a time 110 seconds after the base film came into contact with the surface of the solution was 1.38.

Subsequently, a transfer sheet was prepared by subjecting the base film to printing in a similar manner as Example 3. An aqueous solution, which was prepared by dissolving the transfer sheet in water so that the solid content became to 0.5% by weight, was held at 30° C. and had a surface tension of 37 mN/m. The extension ratio of the print pattern transferred to an ABS resin plate in a similar manner as Example 3 was measured to be 1.23. It was found that a high-definition print pattern was transferred to the ABS resin plate clearly without any print omission or stain. The evaluation results are shown collectively in Table 2.

Example 5

A hydraulic transfer printing base film was prepared in the same manner as Example 3 except changing the water content of the base film to 5.2% by weight. The resulting base film had a retardation of 35 nm. Further, the base film exhibited a transverse shrinkage of 2.4% when a tension of 8.0 kg/m was applied at 50° C. in the longitudinal direction of the film for one minute. The time (T2), needed until the base film dissolved completely in water at 30° C., was 26 seconds.

When the base film was floated on the surface of an aqueous solution in a similar manner as Example 3, wrinkles appeared in the film surface in 7 seconds (T1) after the film came into contact with the surface of the solution, then the wrinkles disappeared and the film surface became smooth in the following 5 seconds (namely, 12 seconds after the film came into contact with the surface of the solution). The ratio (T1/T2) was 0.27. The extension ratio at a time 60 seconds after the base film came into contact with the water surface was 1.50.

Subsequently, when a transfer sheet was prepared by subjecting the base film to printing in a similar manner as Example 3, inks of three colors were printed with a slight misalignment. It is probable that the print misalignment occurred due to a high transverse shrinkage of the base film during the printing resulting from a high water content of the base film. An aqueous solution, which was prepared by dissolving the transfer sheet in water so that the solid content became to 0.5% by weight, was held at 30° C. and had a surface tension of 39 mN/m. In addition, an extension ratio of a print pattern transferred to an ABS resin plate was measured in the same manner as Example 3 to be 1.35. There was no print omission or stain in the print pattern transferred to the ABS resin plate. However, a little unclear print pattern was produced due to the occurrence of the print misalignment. The evaluation results are shown collectively in Table 2.

Example 6

A base film and a transfer sheet were prepared in the same manner as Example 3 except changing the amount of polyoxyethylene lauryl ether used to 6.0 parts by weight. As a result, a blurred print pattern was formed probably because of bleeding of the surfactant to the surface of the film. In addition, hydraulic transfer printing to an ABS resin plate was carried out and then the extension ratio of the print pattern transferred to an article was measured. The extension ratio was 1.20. Blur caused by expansion of a print pattern was successfully controlled, but stains on the surface of the film were also transferred to the ABS resin plate. The evaluation results are shown collectively in Table 2.

Comparative Example 5

A base film and a transfer sheet were prepared and evaluated in the same manner as Example 3 except using polyoxyethylene polystyryl phenyl ether (surface tension measured at 20° C. using a 0.01 wt % aqueous solution=43.0 mN/m; molar number (n) of oxyethylene add=14.5) instead of the polyoxyethylene lauryl ether. Hydraulic transfer printing to an ABS resin plate was carried out and then the extension ratio of the print pattern transferred to an article was measured. The extension ratio was 1.83. There was no print omission or stain in the print pattern transferred to the ABS resin plate. However, no high-definition print pattern was formed due to the occurrence of pattern blur caused by swelling of the print pattern. The evaluation results are shown collectively in Table 2.

Comparative Example 6

A base film and a transfer sheet were prepared and evaluated in the same manner as Example 3 except using 0.02 part by weight of polyoxyethylene cetyl ether (surface tension measured at 20° C. using a 0.01 wt % aqueous solution=38.2 mN/m; molar number (n) of oxyethylene add=15.0) as a surfactant instead of using 1.2 parts by weight of polyoxyethylene lauryl ether. Hydraulic transfer printing to an ABS resin plate was carried out and then the extension ratio of the print pattern transferred to an article was measured. The extension ratio was 2.0. There was no print omission or stain in the print pattern transferred to the ABS resin plate. However, no high-definition print pattern was formed due to the occurrence of pattern blur. The evaluation results are shown collectively in Table 2.

Comparative Example 7

A base film and a transfer sheet were prepared and evaluated in the same manner as Example 3 except adding no surfactant. Hydraulic transfer printing to an ABS resin plate was carried out and then the extension ratio of the print pattern transferred to an article was measured. The extension ratio was 2.3. There was no print omission or stain in the print pattern transferred to the ABS resin plate. However, no high-definition print pattern was formed due to the occurrence of pattern blur. The evaluation results are shown collectively in Table 2.

TABLE 2

| | Surfactant | | | | Performance of base film | | | | | Surface | Extension |
|---|---|---|---|---|---|---|---|---|---|---|---|
| | Kind | Surface tension (mN/m) | Amount (part by weight) | Other additives (part by weight) | Water content (% by weight) | Retardation (nm) | Transverse shrinkage (%) | T1/T2 | Extension ratio (times) | tension of aqueous solution (mN/m) | ratio of print pattern (times) |
| Example 3 | Polyoxy-ethylene lauryl ether | 27.8 | 1.2 | Glycerin (4) | 3.6 | 30 | 1.1 | 0.35 (9/26) | 1.47 | 39 | 1.32 |
| Example 4 | Polyoxy-ethylene oleyl ether | 31.1 | 1.0 | Glycerin (5) Oxidized starch (3) Boric acid (0.3) | 2.8 | 26 | 0.2 | 0.35 (12/34) | 1.38 | 37 | 1.23 |
| Example 5 | Polyoxy-ethylene lauryl ether | 27.8 | 1.2 | Glycerin (4) | 5.2 | 35 | 2.4 | 0.27 (7/26) | 1.5 | 39 | 1.35 |
| Example 6 | Polyoxy-ethylene lauryl ether | 27.8 | 6.0 | Glycerin (4) | 3.6 | 30 | 1.1 | 0.37 (10/27) | 1.28 | 38 | 1.2 |
| Comparative Example 5 | Polyoxy-ethylene polystyryl phenyl ether | 43.0 | 1.2 | Glycerin (4) | 2.8 | 26 | 0.2 | 0.38 (13/34) | 2.1 | 64 | 1.83 |
| Comparative Example 6 | Polyoxy-ethylene cetyl ether | 38.2 | 0.02 | Glycerin (4) | 2.8 | 26 | 0.2 | 0.40 (14/35) | 2.2 | 65 | 2.0 |
| Comparative Example 7 | None | — | — | Glycerin (4) | 2.8 | 26 | 0.2 | 0.43 (15/35) | 2.5 | 65 | 2.3 |

Table 2 shows that the extension ratio of a transfer sheet floated on the surface of an aqueous solution increases as the surface tension of the aqueous solution at the time of transfer rises. Therefore, it is shown that in order to transfer a clear print pattern, it is important to use a base film which contains a proper surfactant in a proper amount and which exhibits an extension ratio not more than a certain level when being floated on an aqueous solution.

The invention claimed is:

1. A method for continuous hydraulic transfer printing, comprising continuously floating a transfer sheet comprising a polyvinyl alcohol polymer film and a print layer formed thereon on a surface of an aqueous solution while directing the print layer upward, and then pressing an article against the surface of the aqueous solution to transfer the print layer to the article, wherein the surface tension of the aqueous solution is adjusted with a polyoxyethylene alkyl ether surfactant to 45 mN/m or less, and wherein no transfer printing occurs prior to said adjusting of the surface tension of the aqueous solution, wherein the polyoxyethylene alkyl ether surfactant is contained in the transfer sheet or added separately, or both, and the transfer sheet exhibits an extension ratio of 1.30 or less during the transfer.

2. The method for continuous hydraulic transfer printing according to claim 1, wherein the surface tension of the aqueous solution is adjusted to 15 mN/m.

3. The method for continuous hydraulic transfer printing according to claim 1, wherein the transfer sheet exhibits an extension ratio of 1.20 or less during the transfer.

4. The method for continuous hydraulic transfer printing according to claim 1, wherein the aqueous solution comprises from 0.001 to 3% by weight of a surfactant.

5. The method for continuous hydraulic transfer printing according to claim 1, wherein the aqueous solution has a solid concentration of from 0.001 to 5% by weight.

6. The method for continuous hydraulic transfer printing according to claim 1, further comprising applying an ink activating solvent before the floating of the transfer sheet on the surface of the aqueous solution.

7. The method for continuous hydraulic transfer printing according to claim 1, wherein a time taken from the floating of the transfer sheet on the surface of the aqueous solution to the pressing of the article against the surface of the aqueous solution is from 40 to 240 seconds.

8. A method for hydraulic transfer printing, comprising adjusting surface tension of an aqueous solution to 45 mN/m or less by addition of a polyoxyethylene alkyl ether surfactant by itself, floating a transfer sheet comprising a polyvinyl alcohol polymer film and a print layer formed thereon on a surface of the aqueous solution while directing the print layer upward, and then pressing an article against the surface of the aqueous solution to transfer the print layer to the article, wherein the transfer sheet exhibits an extension ratio of 1.30 or less during the transfer.

9. The method for hydraulic transfer printing according to claim 8, wherein the surface tension of the aqueous solution is adjusted to 15 mN/m.

10. The method for hydraulic transfer printing according to claim 8, wherein the transfer sheet exhibits an extension ratio of 1.20 or less during the transfer.

11. The method for hydraulic transfer printing according to claim 8, wherein the aqueous solution comprises from 0.001 to 3% by weight of the surfactant.

12. The method for hydraulic transfer printing according to claim 8, further comprising applying an ink activating solvent before the floating of the transfer sheet on the surface of the aqueous solution.

13. The method for hydraulic transfer printing according to claim 8, wherein a time taken from the floating of the transfer sheet on the surface of the aqueous solution to the pressing of the article against the surface of the aqueous solution is from 40 to 240 seconds.

* * * * *

UNITED STATES PATENT AND TRADEMARK OFFICE

CERTIFICATE OF CORRECTION

PATENT NO. : 8,927,061 B2
APPLICATION NO. : 13/296840
DATED : January 6, 2015
INVENTOR(S) : Shintaro Hikasa et al.

It is certified that error appears in the above-identified patent and that said Letters Patent is hereby corrected as shown below:

In the Claims,

Column 21, line 61, “15 mN/m” should read --15 to 45 mN/m--

Column 22, line 61, “15 mN/m” should read --15 to 45 mN/m--

Signed and Sealed this
Second Day of June, 2015

Michelle K. Lee

Michelle K. Lee
*Director of the United States Patent and Trademark Office*